US005365411A

United States Patent [19]

Rycroft et al.

[11] Patent Number: 5,365,411

[45] Date of Patent: Nov. 15, 1994

[54] EXIT SIGNS WITH LED ILLUMINATION

[75] Inventors: David J. Rycroft, Unionville; Abi F. Madadi, Scarborough, both of Canada

[73] Assignee: Kaufel Group Ltd., Scarborough, Canada

[21] Appl. No.: 1,393

[22] Filed: Jan. 6, 1993

[51] Int. Cl.[5] ..... F21V 19/04; G09F 13/18

[52] U.S. Cl. ..... 362/20; 362/235; 362/249; 362/300; 362/800; 362/812; 40/546; 40/549; 40/570; 40/571

[58] Field of Search ..... 40/541, 546, 549, 563, 40/564, 570, 152.2, 571, 582, 583; 362/20, 29, 30, 31, 800, 812, 27, 234, 235, 242, 246, 247, 248, 249, 297, 298, 300, 362, 450

[56] References Cited

U.S. PATENT DOCUMENTS

| | | | |
|---|---|---|---|
| 3,132,811 | 5/1964 | Madansky | 362/31 |
| 3,324,290 | 6/1967 | Lasker | 40/570 |
| 3,423,865 | 1/1969 | Hardesty et al. | 40/563 |
| 3,517,937 | 6/1970 | Glass et al. | 40/571 |
| 3,653,138 | 4/1972 | Cooper | 40/563 |
| 3,665,626 | 5/1972 | Lund et al. | 40/570 |
| 3,680,237 | 8/1972 | Finnerty, Sr. | 40/544 |
| 3,780,462 | 12/1973 | Pregel et al. | 40/544 |
| 3,853,088 | 12/1974 | Marko | 116/286 |
| 4,271,408 | 6/1981 | Teshima et al. | 340/702 |
| 4,385,343 | 5/1983 | Plumly | 362/31 |
| 4,424,449 | 1/1984 | O'Brill | 250/461.1 |
| 4,466,208 | 8/1984 | Logan, Jr. et al. | 40/544 |
| 4,561,203 | 12/1985 | MacDonald, Jr. et al. | 40/570 |
| 4,574,269 | 3/1986 | Miller | 340/97 |
| 4,630,895 | 12/1986 | Abdala, Jr. et al. | 362/31 |
| 4,682,147 | 7/1987 | Bowman | 340/286 R |
| 4,694,600 | 9/1987 | Murray | 40/518 |
| 4,711,044 | 12/1987 | Danjell | 40/543 |
| 4,714,983 | 12/1987 | Lang | 362/27 |
| 4,768,300 | 9/1988 | Rutili | 40/546 |
| 4,791,745 | 12/1988 | Pohn | 40/546 |
| 4,807,092 | 2/1989 | Hasegawa | 362/32 |
| 4,819,353 | 4/1989 | Glucksman et al. | 40/546 |
| 4,884,178 | 11/1989 | Roberts | 362/241 |
| 4,891,896 | 1/1990 | Boren | 40/541 |
| 4,918,578 | 4/1990 | Thompson | 362/31 |
| 4,922,384 | 5/1990 | Torrence | 362/31 |
| 4,929,866 | 5/1990 | Murata et al. | 362/800 |
| 4,942,685 | 7/1990 | Lin | 40/152.2 |
| 4,947,300 | 8/1990 | Wen | 362/183 |
| 4,954,822 | 9/1990 | Borenstein | 340/925 |
| 4,967,317 | 10/1990 | Plumly | 362/31 |
| 4,975,809 | 12/1990 | Ku | 362/31 |
| 4,977,486 | 12/1990 | Gotoh | 362/27 |
| 4,999,936 | 3/1991 | Calamia et al. | 40/544 |
| 5,009,019 | 4/1991 | Erlendsson et al. | 40/541 |
| 5,012,160 | 4/1991 | Thompson | 315/149 |
| 5,018,290 | 5/1991 | Kozek et al. | 40/570 |
| 5,027,258 | 6/1991 | Schöniger et al. | 362/31 |
| 5,036,248 | 7/1991 | McEwan et al. | 313/500 |
| 5,040,320 | 8/1991 | Reidinger | 40/570 |
| 5,047,907 | 9/1991 | Hawkins | 362/311 |
| 5,124,890 | 6/1992 | Choi et al. | 362/27 |
| 5,136,483 | 8/1992 | Schöniger et al. | 362/800 |
| 5,151,679 | 9/1992 | Dimmick | 40/546 |

*Primary Examiner*—Carl D. Price
*Assistant Examiner*—Alan B. Cariaso

[57] ABSTRACT

A light unit for use in lighted sign assemblies has a housing with a rear wall, upstanding opposed side walls, and shield elements extending inwardly from adjacent the upper ends of the side walls. Light arrays extending along the side walls have light emitting diodes disposed in spaced relationship above the rear wall and below the shield elements, and a diffuser extends across the housing above the shield elements. The rear wall is configured to reflect light emitted from the diodes relatively uniformly across the diffuser which further contributes to relative uniform transmission of light therethrough. The power supply may include a circuit to transform alternating current line voltage into a reduced direct current voltage for the diodes, and the power supply may also provide direct current to the diodes from a battery power source when power is interrupted.

21 Claims, 5 Drawing Sheets

EXIT SIGNS WITH LED ILLUMINATION

BACKGROUND OF THE INVENTION

The present invention relates to lighted exit signs and emergency signs, and, more particularly, to light units for such signs.

Exit signs and emergency signs are widely employed in commercial and industrial buildings as well as in multi-unit residential buildings to identify exits and provide other information to persons who may be within the structure. Some such signs are continuously illuminated, others are illuminated only in the event of emergencies such as the loss of power, and still others are illuminated by the building power supply normally and by battery power when building power is lost. Such signs are usually illuminated by two incandescent or compact fluorescent lamps, each of which will normally have a rating of 15–25 watts. The incandescent and fluorescent lamps results in a power requirement which becomes particularly significant when the signs are powered by a battery supply in the event of an emergency.

Recently, there have been efforts to utilize light emitting diodes (LEDs) to effect illumination of exit signs so as to reduce the amount of the power required, and such efforts have necessarily involved the use of a relatively large number of spaced light emitting diodes to provide the necessary candlepower for adequate illumination. In some such signs, the light emitting diodes have been oriented in rows corresponding to the configuration of the letters directly under which they are disposed. Because of this orientation, an undesirable result is that the light emitting diodes produce a multiplicity of bright spots in the illuminated legend of the sign even when diffuser material is placed between the LEDs and the legend sheet or plate.

Another substantial advantage to use of light emitting diodes in addition to the lower power consumption (an array may require only 2 watts), is that they generate less heat and are much longer lived. This also enables the reduction of the size and cost of DC power supplies for emergency power. Accordingly, there are decided advantages to employing LEDs if the objectionable point source effect can be overcome.

It is an object of the present invention to provide a novel light unit for exit and emergency signs incorporating light emitting diodes as the light source and providing diffuse illumination of the indicia of the sign legend.

It is also an object to provide such a light unit providing a substantially uniformly lighted appearance for the characters of the legend.

Another object is to provide such a light unit which can readily replace the incandescent and fluorescent light units in existing exit and emergency signs.

Still another object is to provide such a light unit which may be fabricated readily and economically from components which may be readily assembled.

SUMMARY OF THE INVENTION

It has now been found that the foregoing and related object may be readily attained in a light unit for use in lighted sign assemblies comprising a housing having a rear wall, upstanding side walls along two opposed sides of the rear wall, and shield elements extending inwardly from adjacent the upper ends of the side walls. Extending along the side walls are light arrays which include a multiplicity of light emitting diodes disposed in spaced relationship above the rear wall and below the shield elements. Also included are power supply means to the diodes, and diffuser means extending across the housing above the shield elements. The rear wall is configured to reflect light emitted from the diodes relatively uniformly across the diffuser means which further contributes to relatively uniform transmission of light therethrough.

In the preferred embodiments, the housing is elongated in one axis and the side walls extend along the elongated axis. The rear wall, side walls and shield elements are integrally formed to provide the housing. Conveniently, the housing is extruded from synthetic resin, and the housing additionally includes channels on the side walls above the shield elements in which the diffuser means is seated. Generally, the light assembly will additionally include a legend member over the diffuser element, and it has distinctive indicia forming elements therein.

Desirably, the light arrays include elongated circuit boards upon which the diodes are mounted, and the rear wall and shield elements provide opposed channels seating the upper and lower margins of the circuit boards. The shield elements extend downwardly towards the rear wall and over the ends of the diodes.

Portions of the rear wall are inclined upwardly from the side walls towards a centerline extending generally parallel to the side walls, and the upwardly tapering portions of the rear wall are concave. The rear wall has a depending rib along the centerline to provide support therefor.

Desirably, there are included end closures engaged with the ends of the housing and extending between the side walls. The power supply means includes a circuit to transform alternating current line voltage into a reduced direct current voltage for the diodes. The power supply means also provides direct current to the diodes from a battery source when line power is interrupted.

In a particularly useful embodiment, the light unit is adapted to be inserted into the housing of existing lighted sign assemblies as a replacement light unit for the incandescent and fluorescent lamps of the original equipment.

DETAILED DESCRIPTION OF THE ILLUSTRATED EMBODIMENTS

Figures 1, 2:
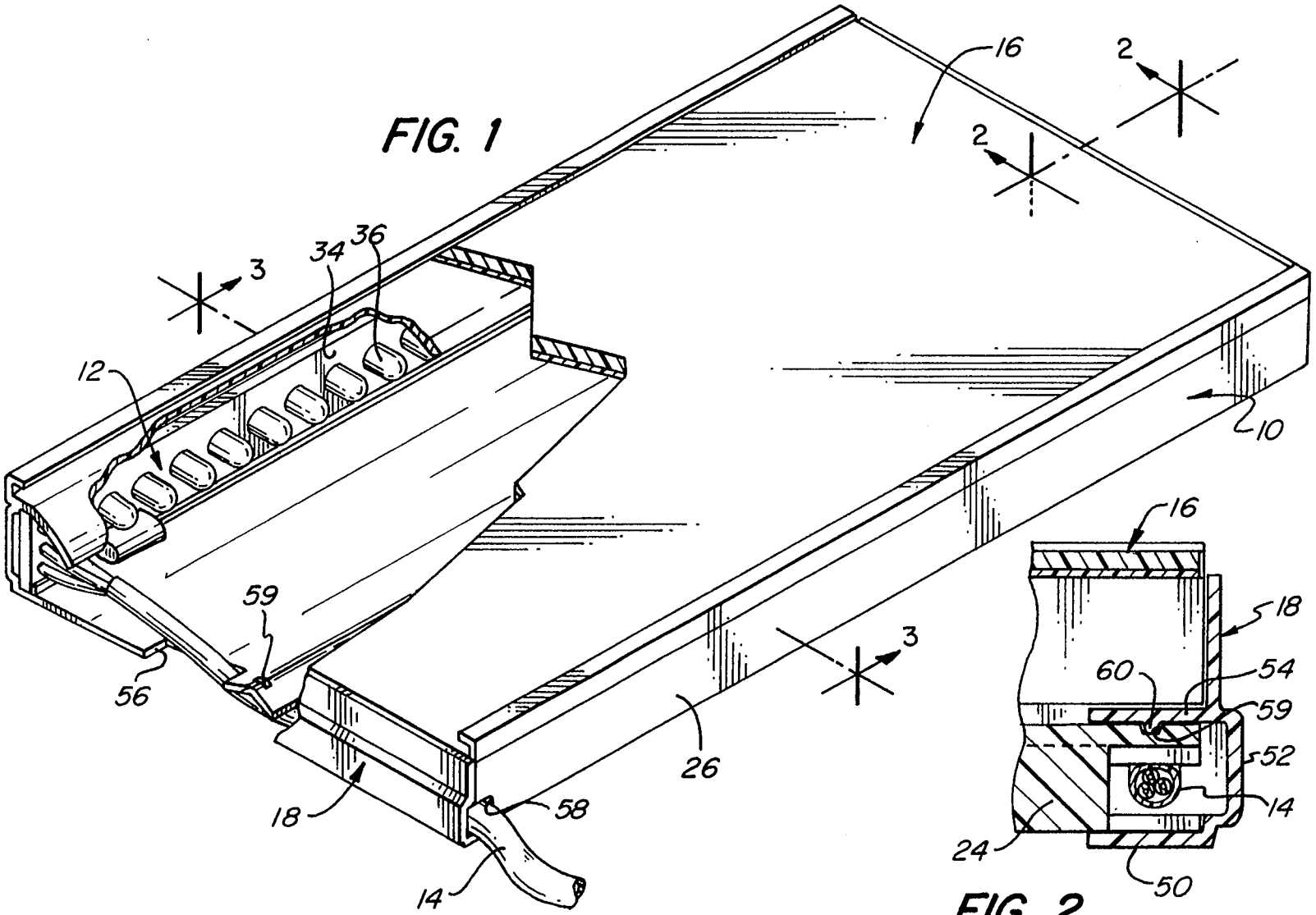
FIG. 1 is a perspective view of a light unit or module embodying the present invention with portions thereof broken away for purposes of illustration.
FIG. 2 is a sectional view of the light unit along the line 2—2 of FIG. 1.

Turning first to FIG. 1, therein illustrated is a light unit or module embodying the present invention which is comprised of the unitary housing generally designated by the numeral 10, a pair of light arrays generally designated by the numeral 12, a cable 14, and a diffuser member generally designated by the numeral 16. As shown, the ends of the housing 10 have engaged therewith end closures generally designated by the numeral 18.

Turning first in detail to the housing 10 as seen in FIGS. 2–5, it is comprised of two elongated rear wall portions 20 which are joined along the longitudinal centerline 22 and the support rib 24 which depends therefrom. Along opposed sides thereof are the upstanding side walls 26 which have inwardly and downwardly inclined shield elements 28 adjacent the upper ends thereof, and opposed lips 30 at the upper ends which define lips 32 in cooperation with the upper surface of the shield elements 28.

Figure 3:
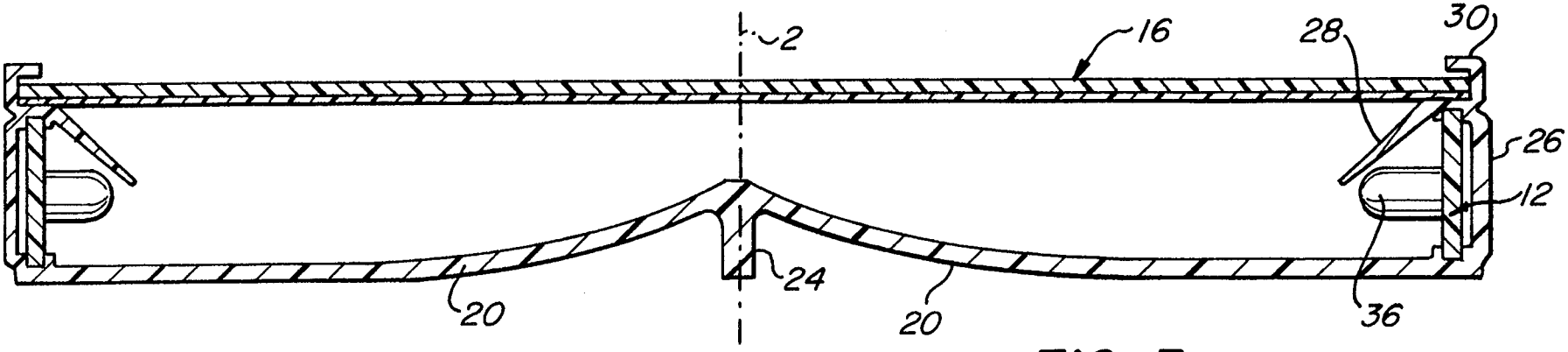
FIG. 3 is a sectional view of the light unit along the line 3—3 in FIG. 1.
Figure 4:
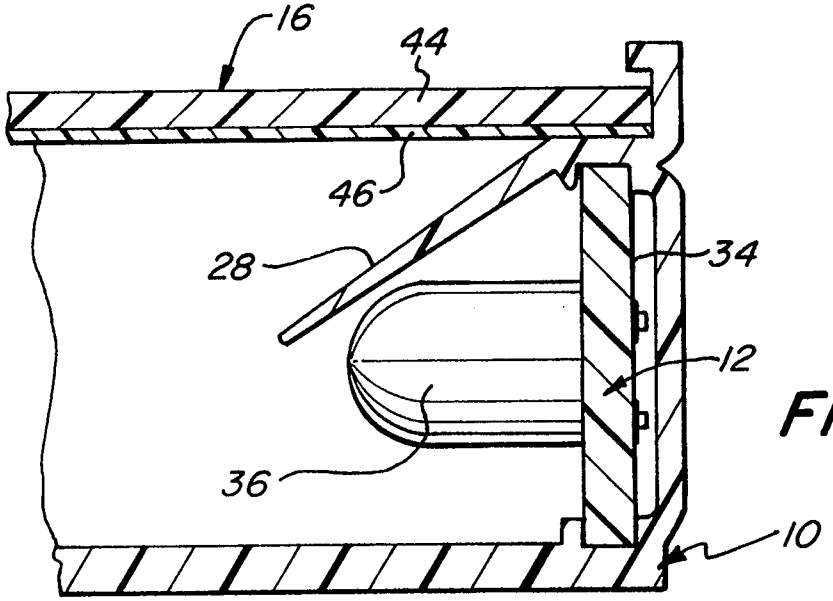
FIG. 4 is an enlarged fragmentary sectional view of a portion of the light unit in FIG. 3.
Figures 5, 6:
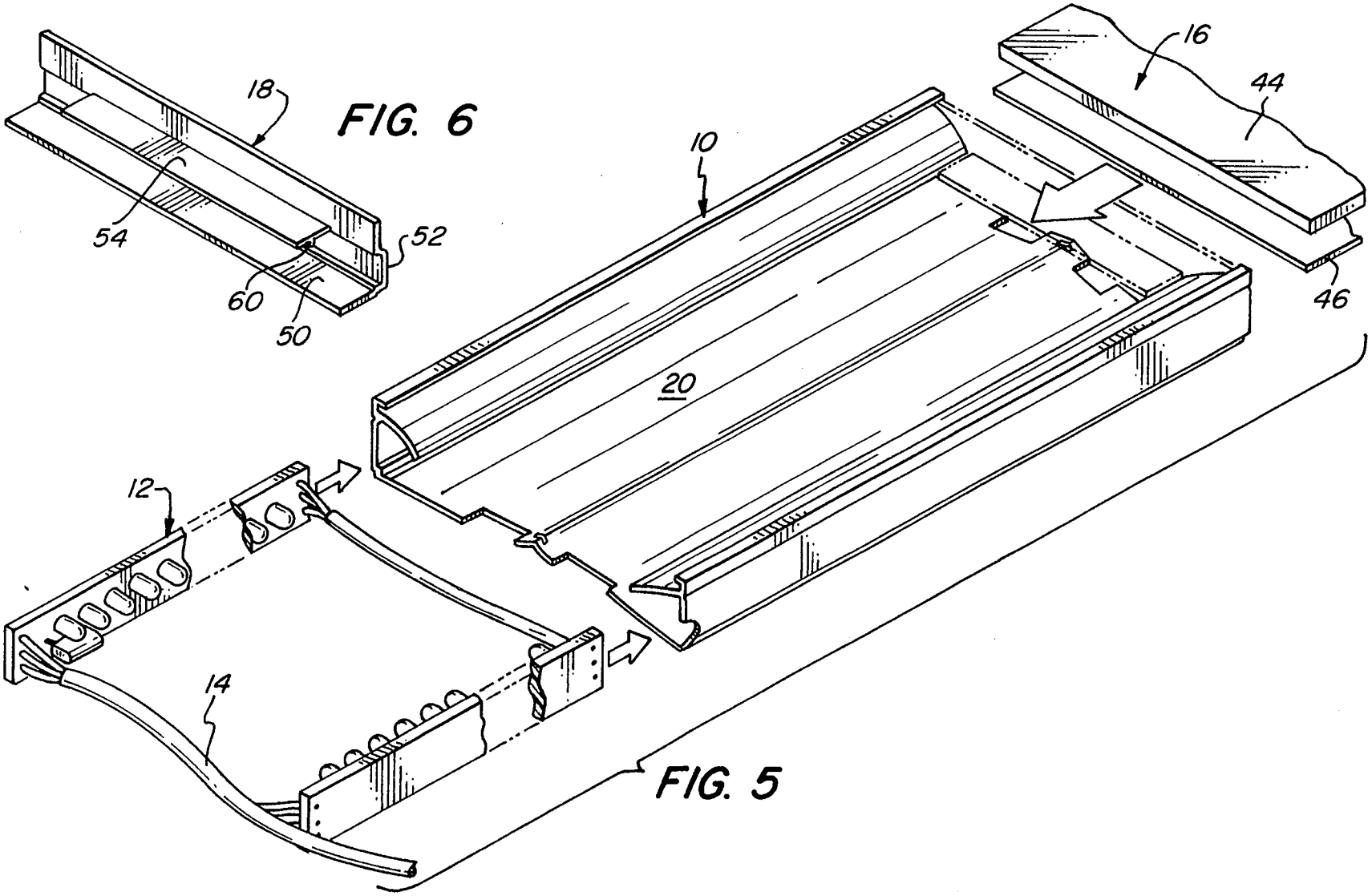
FIG. 5 is a fragmentary exploded view of the components of the light unit of FIG. 1.
FIG. 6 is a perspective view of an end closure of the light unit of FIG. 1.

As can be seen in FIG. 4, the upper surface of the rear wall portions 20 and the lower surfaces of the shield elements 28 are provided with opposed channels 38 which seat the light arrays 12 therein. As best seen in FIG. 3, the rear wall portions 20 have sections adjacent the side walls 26 which are generally planar and sections which taper upwardly therefrom to the centerline 22.

As best seen in FIG. 2, the end closures 18 are conveniently molded or extruded from synthetic resin with a base wall 50, a stepped side wall 52 and a retainer flange 54.

Following extrusion, the rear wall 20 of the housing 10 is die cut adjacent the rib 24 to provide notches 56, and the end of the rib 24 is cut away to permit the power cord 14 to pass under the center portion. The one side wall 26 is also provided with a notch 58 to permit the cord 14 to seat therein. The rear wall 20 also has a notch 59 at its apex adjacent its end to seat the rib 60 on the lower surface of the flange 54 of the end closure 18. After insertion of the light arrays 12 and placement of the power cords 14 in the notches 56 and 58, the end closures 18 are snapped into place with the base wall 50 being disposed under the rear wall 20 and its rib 24, and the rib 60 seating in the notch 59.

The light arrays 12 comprise elongated circuit boards 34 upon which are mounted in spaced relationship the LEDs 36. Depending upon the power supply to the light unit, the circuit boards 34 may include a resistor and capacitor in series and cooperating with a bridge rectifier to reduce and convert AC power input of 120 (or more) volts to the voltage required for powering the LEDs, generally 12 or 24 volts. In a sign which is alternately powered by AC current in the building and by DC battery power upon failure of the building current, the circuit boards may include circuitry connected to both power sources, to operation from battery current in the event of building current failure.

Completing the assembly of the light unit is the diffuser 16 which can assume a number of forms. In the embodiment of FIGS. 1–6, it comprises a multi-element assembly which can be laminated if so desired. Shown is a relatively thick transparent or translucent face element 44 of synthetic resin and a relatively thin diffuser element 46 of sheet material which is provided with lenticular or spherical formations or other physical formations which will substantially refract and diffuse the light passing therethrough, as is well known in the diffuser art.

Figure 8:
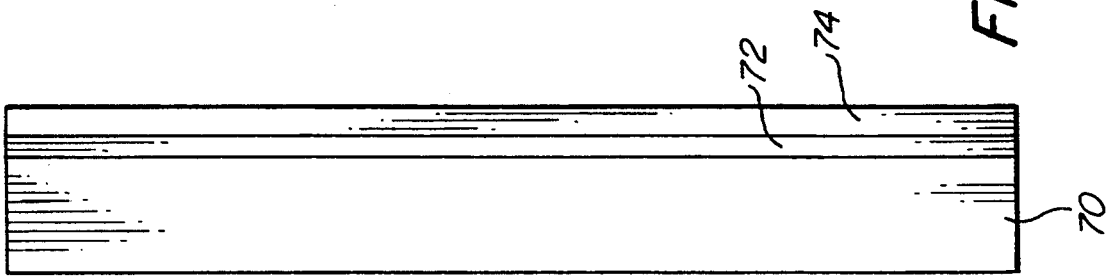
FIG. 8 is a fragmentary view of a diffuser panel which may be used in the light unites.

In the embodiment of FIG. 8, the diffuser element 16 comprises a sheet 70 of transparent synthetic resin which has a coating 72 of the desired coloration and a white translucent coating 74. The two coatings 72,74 function to diffuse the light passing therethrough and may be readily applied by conventional processes such as silk screening, roller coating, spraying and the like. The color of the coating 72 will vary with the specification for the light in which it is used; red and green colorations are most usually employed.

In the embodiment of FIGS. 1–6, no stencil or legend plate has been illustrated since the illustrated unit is a light module only. However, if so desired, the side walls 26 could be modified to enlarge the channels 32 or to superimpose another channel to seat a conventional legend plate. However, this unit would still be intended to seat within an exterior housing which has not been illustrated.

Figure 7:
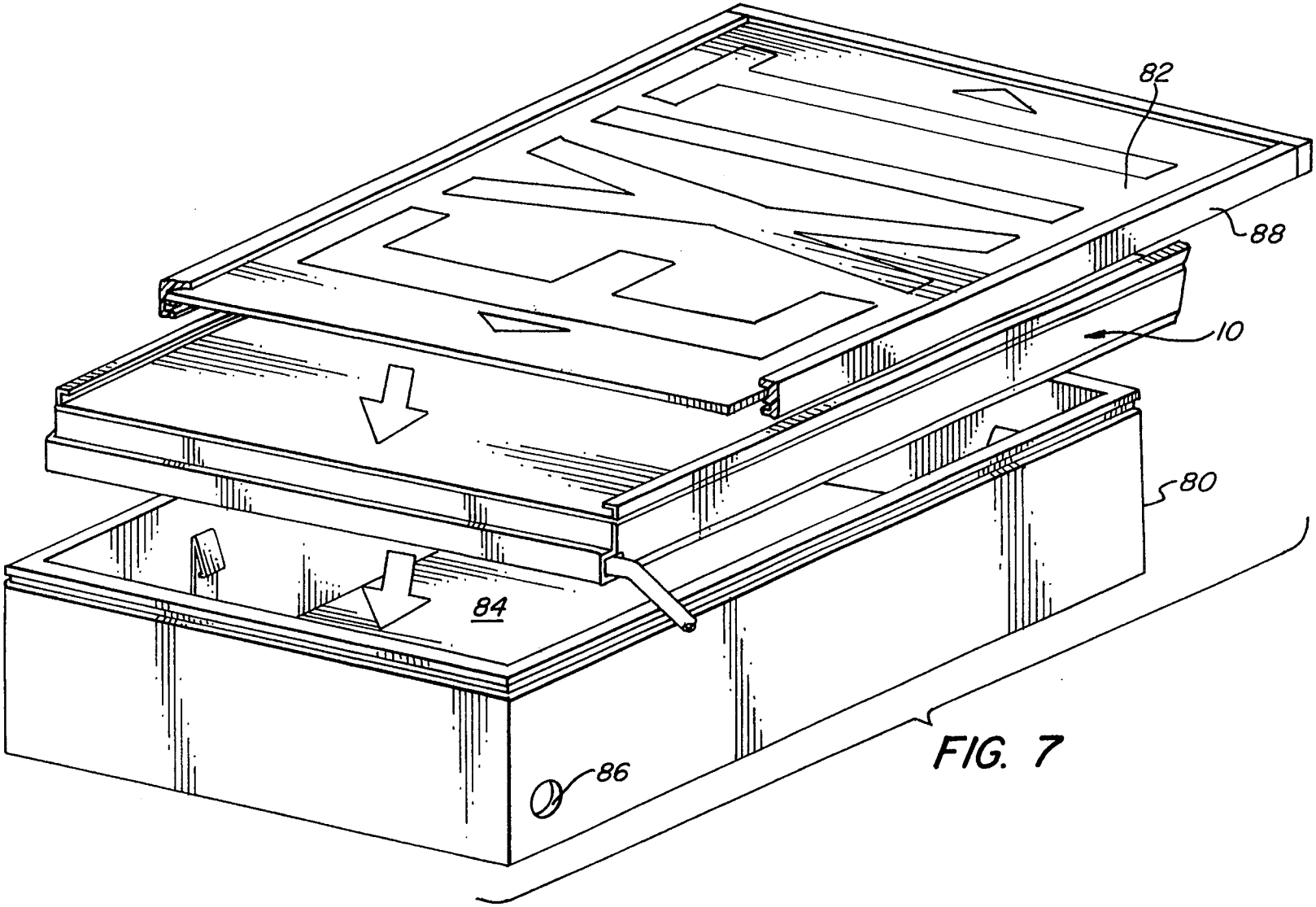
FIG. 7 is an exploded view of a light unit embodying the present invention in combination with the housing and legend plate of an existing lighted exit sign.

Turning now to FIG. 7, the light unit of the present invention is shown in combination with the exterior housing 80 and legend plate 82 of an exit sign which it is to retrofit. To do so, the existing incandescent or fluorescent lamp unit (not shown) is removed and the light unit of the present invention is inserted into the housing. Although various techniques may be used for securing the light unit housing 10 to the base wall 84 of the exterior housing 80, double faced adhesive tape (not shown) has been found highly satisfactory. Liquid adhesives, clips, rivets and other fasteners may also be employed. The power cord 14 is led outwardly through the aperture 86 in the exterior housing 80 before the unit is secured in place. Aperture 86 may be located on the end, top or back of the exterior housing, depending upon location of the power source and mounting canopy. After the replacement light unit has been secured, the legend plate 82 in its frame 88 is mounted on the outer housing 80.

Figure 9:
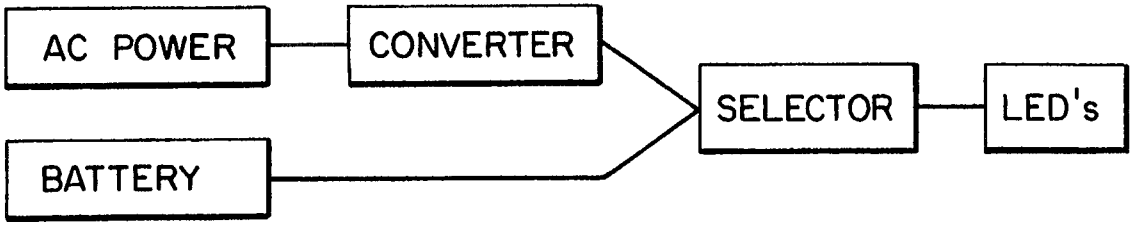
FIG. 9 is a schematic diagram of the power supply for the diodes.

Turning last to FIG. 9, therein diagrammatically illustrated is preferred circuitry for the unit of the present invention to enable operation both on AC building current and on DC emergency battery current. The preferred constructions provide the conversion and voltage reduction circuit as solid state elements on the circuit board 34 together with a diode or other isolation component for the live power sources. The leads from the AC power source and from the DC power source are both connected to the circuit boards so that the same LEDs may be powered by either source. This is readily effected when the LEDs are functioning at 12 volts or higher.

However, for some applications the circuit boards may be printed with conductive paths so that some LEDs function with the reduced and converted AC voltage supply and others with the DC power supply.

Moreover, although less desirable, the components for reducing and converting the AC power supply to DC for the LEDs may be provided in a separate circuit element; however, solid state components should still be used to minimize power requirements, heat generation, etc.

In operation of the light unit of the present invention, the LEDs are positioned with their axes parallel to the face plate and the light emitted by the diodes is deflected from passage direction upwardly to the diffuser by the shield elements. Thus, the light passes upwardly through the diffuser must be from the rear wall of the housing. By providing the contour to the rear wall as illustrated in the attached drawings, the light reflected from the surface of the rear wall is fairly uniform in intensity and is diffuse. Further diffusion of the light passing upwardly through the diffuser is effected by the construction of the diffuser itself to present apparently uniform intensity in the light exiting the legend plate. At no time are the point sources of light presented by the LEDs visible because of the presence of the shield elements.

As will be readily appreciated, the housing element and the end closure elements are readily fabricated from synthetic resin either by extrusion or molding processes. When extrusions are employed, the notches and other cutouts may be readily die cut or punched into a suitable length of the extrusion. Moreover by using an extrusion, the size of the light unit may be readily varied to fit within different lengths of exterior housings. Various resins may be employed for the fabrication of the housing and end closures. ABS (styrene/acrylonitrile/-butadiene) resins have been found highly satisfactory because of the desired degree of resilience and ease of forming. However, other resins may be also employed including polycarbonates, polyamides and polyvinyl chloride homopolymers and interpolymers. To provide the desired degree of reflection from the rear wall, it is desirable that the surface be a bright, smooth, white surface so that appropriate steps should be taken in forming any extrusion dies or injection molds to ensure a high degree of smoothness to provide the necessary luster to the surface.

Similarly, the various resins may be employed for fabricating the body or face plate of the diffuser. Conventionally, acrylic resins such as polymethyl methacrylate are most commonly employed. However, other resins providing the desired degree of translucency or transparency, may be substituted, and glass may also be employed, although less desirably.

To comply with the regulations which are prevalent for many of exit signs, the resins which are employed should either be fire retardant or incorporate fire retardants.

The advantages to the present invention will be readily apparent when one compares the conventional 30–50 watts required for existing incandescent or fluorescent light units, with the power drain of less than 5 watts and typically about 2 watts for light units fabricated in accordance with the present invention.

Moreover, use of the LED light sources using the solid state circuitry described herein avoids the necessity for a transformer and significantly reduces the heat and noise, as well as the power requirements. As is well known, LEDs have extremely long life when compared to conventional incandescent and fluorescent lamps and, thus, the units of the present invention provide a long lived assembly.

As is also well known, the legend plates employed in such exit and emergency signs vary in the nature of their construction. Most prevalent are metal stencil plates in which the indicia are cut from the metal so that the light passes through only the cutout areas. However, other stencil plates are coated with opaque material or have the characters differentially colored with respect to the background so that light passing through the legend plate will vary in coloration as viewed by the passersby.

Thus, it can be seen from the foregoing detailed description and attached drawings that the light unit of the present invention enables substantially lower power consumption while providing a substantially uniformly lighted appearance for the characters of the legend. It can be used to readily replace conventional incandescent and fluorescent light units in existing exit and emergency signs, and it may be fabricated readily and economically from components which are readily assembled and in sizes which may be readily varied.

Having thus described the invention, what is claimed is:

1. A light unit for use in lighted sign assemblies comprising:

(a) a housing having;
  (i) a rear wall,
  (ii) upstanding side walls along two opposed sides of said rear wall, and
  (iii) shield elements extending inwardly from adjacent the upper ends of said side walls;
(b) light arrays extending along said side walls and including a multiplicity of light emitting diodes disposed in spaced relationship above said rear wall and below said shield elements;
(c) power supply means to said diodes; and
(d) diffuser means extending across said housing above said shield elements, said rear wall being configured to reflect light emitted from said diodes relatively uniformly across said diffuser means which contributes to relative uniform transmission of light therethrough.

2. The light unit in accordance with claim 1 wherein said housing is elongated in one axis and said side walls extend along said elongated axis.

3. The light unit in accordance with claim 1 wherein said housing is integrally formed with said rear wall, side walls and shield elements.

4. The light unit in accordance with claim 3 wherein said housing is extruded from synthetic resin.

5. The light unit in accordance with claim 1 wherein said housing additionally includes channels on said side walls above said shield elements, and said diffuser means is seated therein.

6. The light unit in accordance with claim 5 wherein there is additionally included a legend member over said diffuser element, said legend member having distinctive indicia forming elements therein.

7. The light unit in accordance with claim 1 wherein said light arrays include elongated circuit boards upon which said diodes are mounted.

8. The light unit in accordance with claim 7 wherein said rear wall and shield elements provide opposed channels seating the upper and lower margins of said circuit boards.

9. The light unit in accordance with claim 1 wherein said shield elements extend downwardly towards said rear wall over the ends of said diodes.

10. The light unit in accordance with claim 1 wherein portions of said rear wall are inclined upwardly from said side walls towards a centerline extending generally parallel to said side walls.

11. The light unit in accordance with claim 10 wherein said upwardly inclined portions of said rear wall are concave.

12. The light unit in accordance with claim 10 wherein said rear wall has a depending rib along said centerline to provide support therefor.

13. The light unit in accordance with claim 1 wherein there are included end closures engaged with the ends of said housing and extending between said side walls.

14. The light unit in accordance with claim 1 wherein there is included a circuit to transform alternating current line voltage into a reduced direct current voltage for said diodes.

15. The light unit in accordance with claim 13 wherein said light unit is a replacement lamp unit dimensioned and configured to be inserted into the outer casing of an existing lighted sign assembly.

16. The light unit in accordance with claim 14 wherein said power supply means also provides direct current to said diode from a battery power source when power is interrupted.

17. A light unit for use in lighted sign assemblies comprising:

(a) an elongated housing having;

(i) a rear wall, (ii) upstanding side walls along the elongated opposed sides of said rear wall, and (iii) shield elements extending inwardly from adjacent the upper ends of said side walls, portions of said rear wall being inclined upwardly from said side walls towards a centerline extending generally parallel to said side walls;

(b) light arrays extending along said side walls and including a multiplicity of light emitting diodes disposed in spaced relationship above said rear wall and below said shield elements;

(c) power supply means to said diodes; and (d) diffuser means extending across said housing above said shield elements, said rear wall being configured to reflect light emitted from said diodes relatively uniformly across said diffuser means which contributes to relatively uniform transmission of light therethrough.

18. The light unit in accordance with claim 17 wherein said housing is integrally extruded from synthetic resin to provide said rear wall, side walls and shield elements.

19. The light unit in accordance with claim 1 wherein said housing additionally includes channels on said side walls above said shield elements and said diffuser means is seated therein, and wherein said rear wall and shield elements provide opposed channels seating said light arrays.

20. The light unit in accordance with claim 17 wherein there is additionally included a legend member over said diffuser element, said legend member having distinctive indicia forming elements therein.

21. The light unit in accordance with claim 17 wherein said upwardly inclined portions of said rear wall are concave, and wherein said rear wall has a depending rib along said centerline to provide support therefor.

* * * * *